United States Patent [19]

Matai et al.

[11] Patent Number: 4,956,641

[45] Date of Patent: Sep. 11, 1990

[54] RADIO PAGING DEVICE HAVING CIRCUITRY OF REWRITING A STORED MESSAGE WITH ERROR-FREE CHARACTERS

[75] Inventors: Masahiro Matai; Takashi Oyagi; Yutaka Ichikawa; Shinjiro Umetsu, all of Tokyo, Japan

[73] Assignee: NEC Corporation, Japan

[21] Appl. No.: 179,254

[22] Filed: Apr. 8, 1988

Related U.S. Application Data

[63] Continuation-in-part of Ser. No. 833,095, Feb. 25, 1986, abandoned.

[30] Foreign Application Priority Data

Feb. 28, 1985 [JP] Japan ..... 60-37595

[51] Int. Cl.[5] ..... G08B 5/22

[52] U.S. Cl. ..... 340/825.44; 340/311.1; 371/69.1

[58] Field of Search ..... 340/825.44, 825.47, 340/825.48, 311.1; 455/31, 36, 38; 379/56, 57; 371/69, 30, 34, 69.1; 364/200 MS File, 900 MS File

[56] References Cited

U.S. PATENT DOCUMENTS

| | | | |
|---|---|---|---|
| 3,732,541 | 4/1973 | Neubauer | 371/69 |
| 3,781,794 | 12/1973 | Morris | 371/69 |
| 3,976,995 | 8/1976 | Sebestyen | 340/825.44 |
| 4,369,443 | 1/1983 | Giallanza et al. | 340/825.44 |
| 4,383,257 | 5/1983 | Giallanza et al. | 340/825.44 |
| 4,477,807 | 10/1984 | Nakajima et al. | 340/825.44 |
| 4,541,095 | 9/1985 | Vries | 340/825.44 |
| 4,653,055 | 3/1987 | Micic et al. | 371/69 |
| 4,759,022 | 6/1988 | Akerberg | 371/69 |
| 4,835,777 | 5/1989 | De Luca et al. | 371/69.1 |

FOREIGN PATENT DOCUMENTS 8604476 6/1986 PCT Int'l Appl. ..... 340/825.44

*Primary Examiner*—Donald J. Yusko
*Assistant Examiner*—Edwin C. Holloway, III
*Attorney, Agent, or Firm*—Laff, Whitesel, Conte & Saret

[57] ABSTRACT

In a radio display pager, each character of a received multi-character message is checked for error. A first message arrival or a first receive message is stored in a temporary memory and thereafter rewritten into one of main memories when the next message or second message arrival is received. The temporary memory stores the most recent message arrival and the main memories store a plurality of like messages, according to their successive order of earlier arrivals. Each of the messages in both memories contain both error-free and error-containing characters. The characters stored in the temporary memory respectively correspond in position to the characters stored in each of the main memories. A comparison is made between each error-free character in the temporary memory and each of the positionally corresponding error-free characters in one of the main memories in order to detect a match and mismatch. If a mismatch is detected, all characters of each main memory are transferred to an adjacent main memory in order to vacate a storage area. Then, all characters in the temporary memory are transferred to the vacated area for display. If a match is detected, it is counted for all characters of the received message. If the count is smaller than a threshold value, all characters of each main memory are transferred to an adjacent main memory in order to vacate a storage area. All characters in the temporary memory are transferred to that vacated area for display. If the count of the matches is greater than the threshold value, all the error-free characters in the temporary memory are transferred to one of the main memories for display.

9 Claims, 5 Drawing Sheets

RADIO PAGING DEVICE HAVING CIRCUITRY OF REWRITING A STORED MESSAGE WITH ERROR-FREE CHARACTERS

RELATED APPLICATION

This application is a Continuation-in-part application of copending U.S. patent application Ser. No. 833,095 filed Feb. 25, 1986, now abandoned.

BACKGROUND OF THE INVENTION

The present invention relates to radio display pagers and more particularly to a radio display pager in which successively received message signals are compared against each other for verification prior to message display.

As shown and described in U.S. Pat. No. 4,477,807 issued to T. Nakajima et al, radio pagers include a receiver for receiving repeatedly transmitted versions of the same message signal and a memory for storing the successive versions of the same message and the addresses contained therein. In such radio pagers, the successive versions are compared character by character to detect a match regardless of characters in error. If a mismatch occurs, they are identified as being different messages and stored in respective memory locations arranged in a chronological order. If the received signals are severely affected with noise, the successive versions of the same message are likely to be dentified as being different messages and the memory will be overflowed with such error messages.

SUMMARY OF THE INVENTION

It is therefore an object of the invention to provide a radio display pager having a less likelihood of being overflowed with error-containing messages.

The radio display pager has a receiver for receiving a paging signal containing a calling address and a message, a decoder for decoding the address to detect a match or mismatch with the user's unique address, and a display for displaying the message if a match is detected.

According to the present invention a pager receives a paging signal containing an address and a multi-character message. If the address contained therein coincides with a unique address assigned to the pager, the presence or absence of an error is detected in each character of the received message for identifying those characters having no error as being error-free characters, and for identifying those characters in error as being error-containing characters. A first arrival or first received message is then stored into a temporary storage area and rewritten into one of a plurality of main storage areas when a second arrival or second received message is received. Thus, the temporary storage area stores only the most recent arrival or most recently received message. At a given instant of time, the main storage areas store a plurality of like messages, of successively earlier arrivals.

Thus, each of the messages in both the temporary storage area and the main storage areas contain both error-free and error-containing characters. The characters stored in the temporary storage area respectively correspond in position to the characters stored in each of the main storage areas. A comparison is made between each of the error-free characters in the temporary storage area and each of the positionally corresponding error-free characters in the main storage areas, the comparison indicating either a match or a mismatch.

If a mismatch is detected, all characters of each of the main storage areas are transferred to an adjacent one of the main storage areas in order to vacate a storage area. All characters in the temporary storage area are transferred to the vacated storage area for display. If a match is then detected, it is counted for all characters of a given message.

If the count of the detected matches is smaller than a threshold value, all characters of each main storage area are transferred to an adjacent one of the main storage areas in order to vacate a storage area. Then, all characters in the temporary storage area are transferred to this vacated area for display. If the count of the matches is greater than the threshold value, all the error-free characters in the temporary storage area are transferred to one of the main storage areas for display.

Preferably, the detected mismatch is counted and if this count becomes equal to the number of the main storage areas, all of the characters of each of the main storage areas, are transferred to an adjacent one of the main storage ares in order to vacate a storage area. All characters in the temporary storage area are then transferred to the vacated storage area for display. Furthermore, if the count of the matches is smaller than the threshold value, the storage area is compared with the next main storage area. If the count of the detected matches is smaller than the threshold for all main storage areas, all characters of each of the main storage areas are transferred to an adjacent one of the main storage area in order to vacate a storage area. All characters of the temporary storage area are transferred to the vacated storage area for display.

BRIEF DESCRIPTION OF THE DRAWINGS

The present invention will be described in further detail with reference to the accompanying drawings, in which.

DETAILED DESCRIPTION

Figure 1:
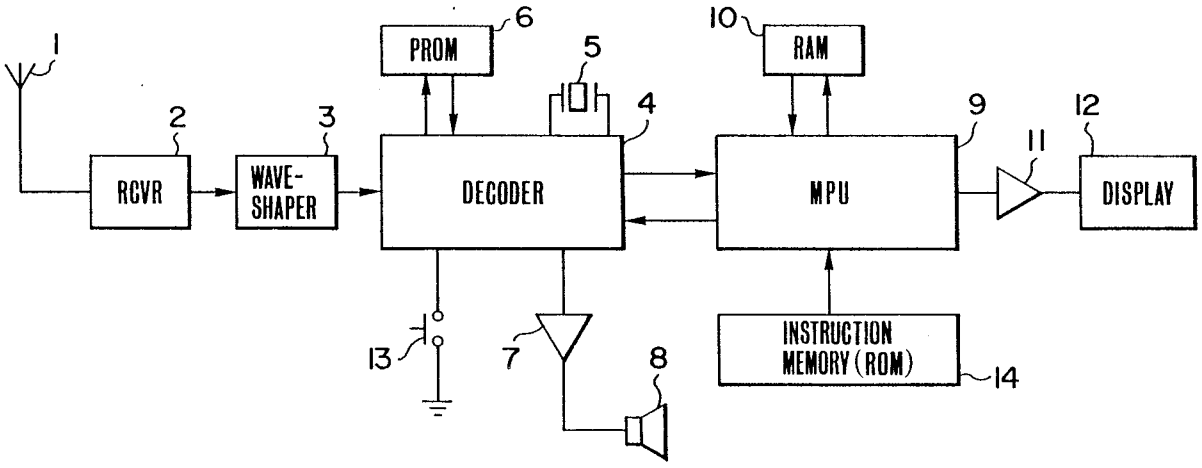
FIG. 1 is a schematic block diagram of a radio display pager of the present invention.
Figure 2A:
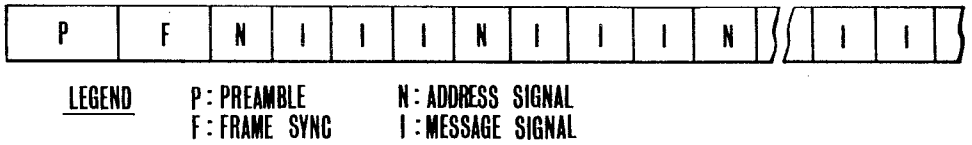
FIGS. 2A–2C are illustrations of data formats employed in the invention.
Figure 2B:
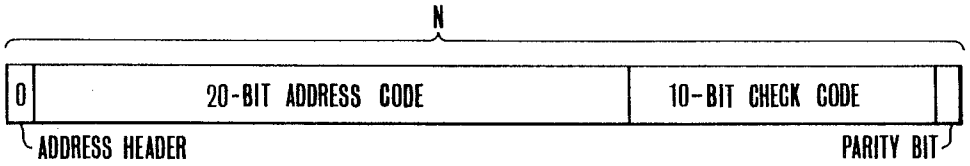
Figure 2C:
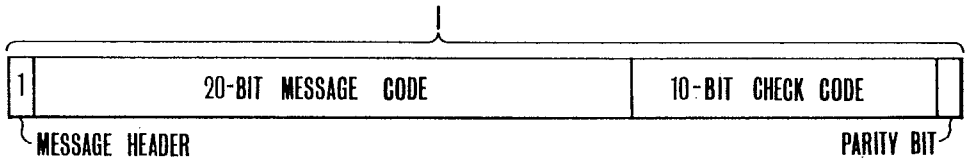

In FIG. 1, a radio display pager of the invention is schematically illustrated. Radio paging signals are intercepted by antenna 1 and fed to a receiver 2 for demodulation and amplification and applied to a waveshaper 3 for shaping the signals into form suitable for digital processing. As shown in FIG. 2A, each paging signal is composed of a preamble P indicating the beginning of the paging signal, a frame sync F, calling addresses N and messages I. The calling address is composed of 32 bits of Bose-Chaudhuri-Hochquenghem (32, 21) code format and a parity bit, which code starts with with a binary-0 address header and has 20 subscriber address bits and 10 error check bits. As shown in FIG. 2C, each message is also organized in the BCH (32, 21) code format and a parity bit, which code begins with a binary-1 message header and has 20 message bits and 10 error check bits. The message code comprises two seven-bit characters. Because of the binary system limitations, the remaining six bits are all binary zero's if no other information that follows represents the higher six bits of the next character and if the amount of information exceeds two characters.

A decoder 4, which is clocked by a crystal-controlled oscillator 5, processes the output of the waveshaper 3 by performing error detection and correction using the parity and error check codes of the address N. The error-corrected address of each paging signal is compared with the user's identification stored in a programmable read-only memory 6 on a bit-by-bit basis. If they match, the decoder 4 activates loudspeaker 8 through an amplifier 7 to alert the user by giving off a tone and sends the message accompanying the identified address to a microprocessor 9. The sounded tone is stopped by a reset switch 13.

Figure 6:
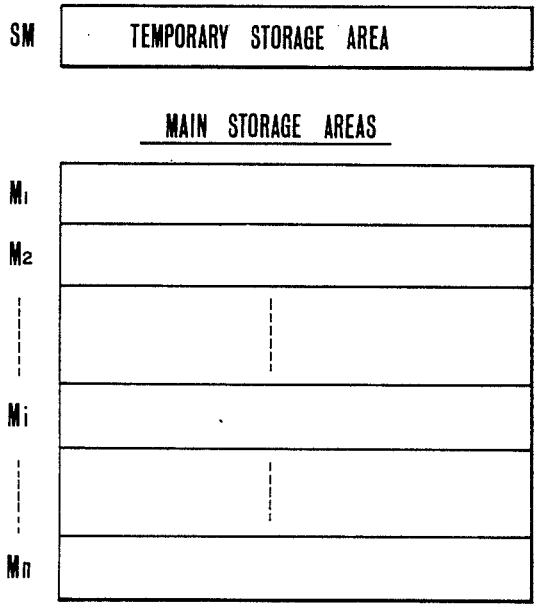
FIG. 6 is an illustration of temporary and main storage areas.

Microprocessor 9 operates in accordance with programmed instructions stored in an instruction memory 14. The programmed instructions include an error check routine by which the contents of repeatedly transmitted versions of the same message are checked for error, the error-checked messages being stored into a temporary storage area SM (FIG. 6) defined in a random access memory 10. The instructions include a display routine by which a message is displayed on a liquid crystal display 12.

Figure 3:
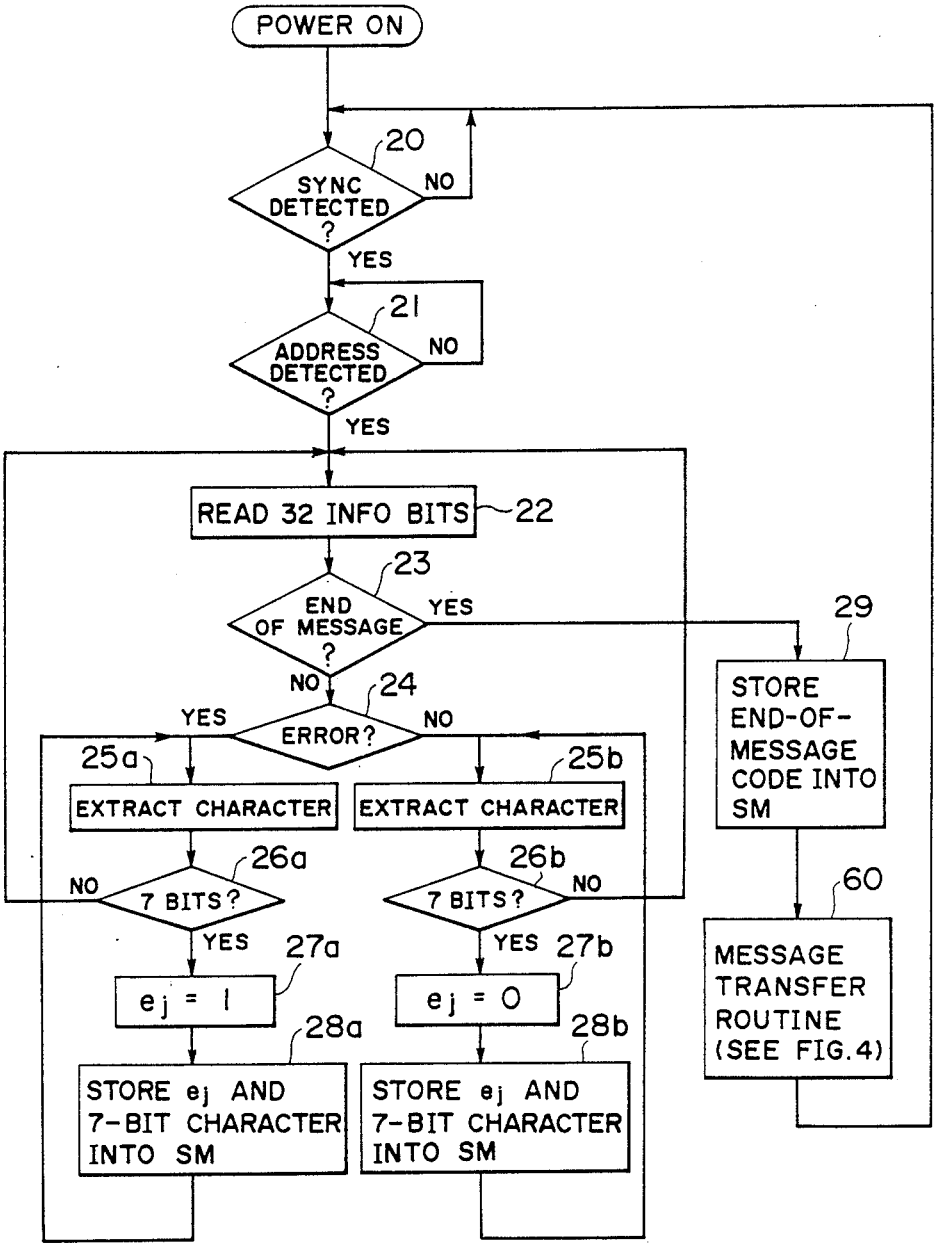
FIG. 3 is a flowchart describing a programmed error check routine.

As shown in FIG. 3, the error check routine starts with turn on of power and calls for the detection of a frame sync (block 20). Exit from decision block 20 is to decision block 21 which tests for the presence of a match between the received calling address code and the user's identification stored in memory 6. Decision blocks 20 and 21 are executed by the decoder 4. The instructions of the microprocessor 9 actually start with operations block 22 which directs the reading of 32 bits from the RAM 10. Exit from operations block 22 is to decision block 23 which checks to see if the 32 bits indicate the end of a message which comprises one or more message units I. This is achieved by examining the contents of a subsequent address. If the readout 32 bits indicate the code format of an address, control recognizes that the message has terminated and proceeds to operations block 29. If the answer is negative, control proceeds to decision block 24 which provides an error check on the 32 bits of information just read out of RAM 10.

Figure 5:
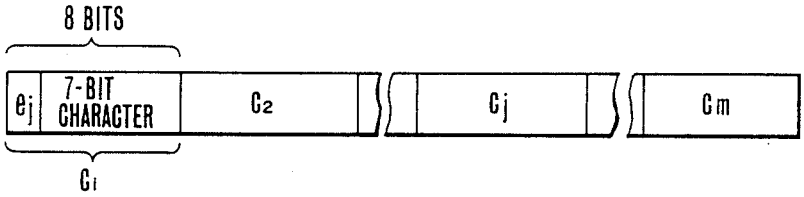
FIG. 5 is an illustration of data format for an error checked message.

If there is an error, the exit is to operations block **25*a* which directs the extracting of a character from the error-checked 32 bits. Then, the exit is to decision block 26*a* which checks to see if the extracted character has 7 bits. If the answer is affirmative, control goes to operations block 27*a* which directs the writing of a "1" into an error indicating bit position (ej) that precedes a 7-bit character to form an 8-bit code (FIG. 5). Exit from block 27*a* is to operations block 28*a* which directs the storing of the 89-bit code into the temporary storage area SM defined in RAM 10. Exit from block 28*a* is to block 25*a* to repeat the above process, so that when the process approaches the end of a 32-bit message unit I, the number of bits contained in the extracted character becomes smaller than 7. Hence, the answer in decision block 26*a* becomes negative. Control now returns to block 22** to read the next 32-bit message unit I.

If no error is detected in the error-checked 32-bit message unit I by decision block 24, the exit therefrom is to operations block **25*b* which directs the extracting of a character in a manner similar to block 25*a*. Decision lock 26*b* follows to check for the correct number of bits in the extracted characters in order to allow control to proceed to operations block 27*b* which directs the writing of a "0" into the error indicating bit (ej) preceding the 7-bit character to form an 8-bit code. This 8-bit code is stored in the storage area SM. Control now returns to operations block 25*b* to repeat the process unitil the answer in block 26*b* becomes negative at the end of a message, whereupon control returns to block 22**.

At the end of a message, the answer in decision block 23 becomes affirmative and control executes operations block 29 by storing an end-of-message code "*" into storage area SM and proceeds to a message transfer routine 60.

Figure 4:
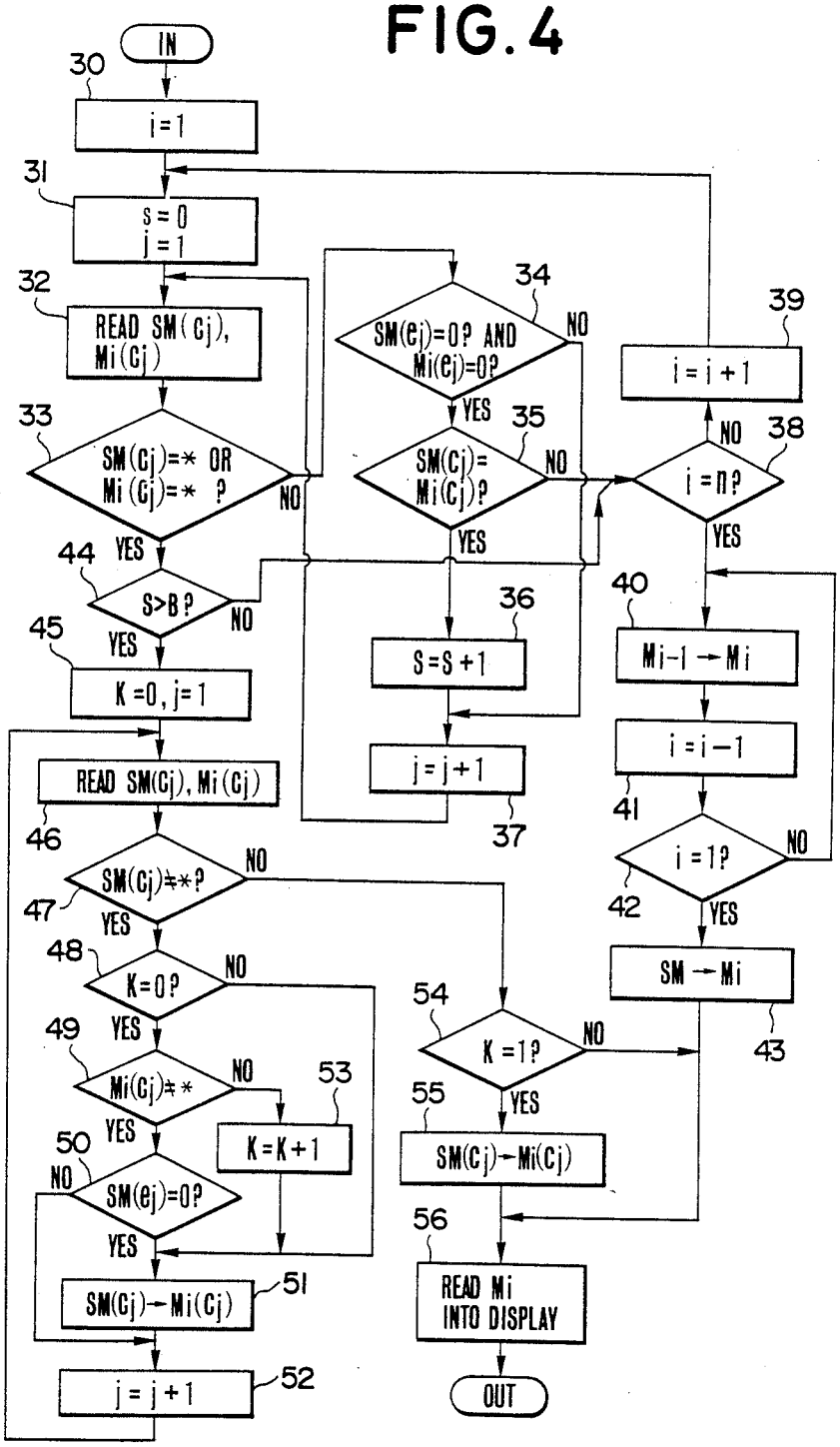
FIG. 4 is a flowchart describing a message display routine.

As shown in FIG. 4, the message transfer routine starts with a block 30 which initializes a variable "i" to "1". Variable "i" indicates the location of each of main storage areas $M_1$ to $M_n$ (FIG. 6) which are defined in RAM 10. Received messages are stored in main storage areas $M_1$ through $M_n$ in chronological order with the subscript "1" indicating the most recently received message and the subscript "n" indicating the oldest one. Exit from initialization block 30 is to second initialization block 31 which sets variable "S" to "0" and a variable "j" to "1". Variable "S" indicates the count of matches between each message character stored in temporary storage area SM and a corresponding character stored in main storage area $M_i$. Variable "j" indicates the position of each character in the temporary storage area SM and main storage area $M_i$. Exit is then to block 32 which reads a character Cj from position "j" of temporary storage area SM and a corresponding character Cj from position "j" of main storage area $M_i$. Decision block 33 next tests for the presence of an end-of-message code "*" in either of the characters Cj just read out of the memory areas SM and $M_i$. If there is none, control proceeds to decision block 34 to check for the presence of a binary "0" in the error bit position in both of the characters Cj. If it is detected, control recognizes that there is no bit error in these characters SM(Cj) and $M_i$(Cj) and control exits to decision block 35 which tests for the detection of a match between the characters SM(Cj) and $M_i$(Cj). If there is one, exit from decision block 35 is to operations block 36 which increments the variable "S" by one. Exit then is to operations block 37 which increments the variable "j" by one and causes control to return to operations block 32. If a binary 1 is detected in bock 34, control recognizes that there is an error in one or both of the two characters to be compared in decision block 35 and jumps to operations block 37 to increment the variable "k", skipping blocks 35 and 36.

If there is a mismatch between the characters compared in decision block 35, exit from block 35 is to decision block 38 which tests to see if the variable "i" is equal to "n" indicating the main storage area $M_n$. If the variable "i" is smaller than "n", exit from block 38 is to operations block 39 which increments the variable "i" by one. The program now returns to operations block 31.

If a mismatch is repeatedly detected in block 35, blocks 31, 32, 33, 34, 35, 38 and 39 are therefore repeatedly executed until variable "i" reaches "n". Control subsequently exits from decision block 38 to operations block 40 which directs the transfer of characters from main storage area $M_{i-1}$ to the next main storage area $M_i$. Exit from block 40 is to block 41 which decrements the variable "i" by one. Variable "i" is successively decremented by a loop which executes block 42 which tests for the presence of i=1 and, if there is one, causes an exit from decision block 42 to operations bock 40. When the variable "i" is decremented to "1", exit from decision block 42 is to operations block 43 which directs transfer of the characters from storage area SM to main storage area $M_1$.

The character transfer operation also occurs if there is a substantial amount of errors in the message in either of the temporary or main storage areas even though there is a match between the characters of the remaining sets. This character transfer is achieved by decision block 44 which, after an end-of-message code is detected in block 33, tests to see if the count "S" is greater than a prescribed value B, which is determined on the basis of the length of message to be stored in the main storage area $M_i$. If the count "S" is smaller than the prescribed value, exit from decision block 44 is to block 38.

Main storage areas M1 through Mn may be filled with error-free versions of different messages as well as error-containing versions of the same message and the oldest message version may be overflowed from the storage area $M_n$.

Count "S" exceeds the prescribed value B if the received signal is not severely affected with errors. If this is the case, blocks 32 through 37 are repeatedly executed until the count "S" reaches the prescribed value B and control exits from block 44 to initialization block 45 which resets a flag "K" to zero and initializes the variable "j" to "1". Flag K indicates which one of the messages stored in the temporary storage area SM and main storage area $M_i$ is longer than the other. Exit is then to operations block 46 which directs the reading of characters SM(Cj) and $M_i$(Cj) and causes an exit from block 46 to decision block 47 which tests for the absence of an end-of-message code in the characters stored in temporary memory SM. If there is no end-of-message code, exit from decision block 47 is to decision block 48 which checks to see if the count "K" is zero. If the answer is affirmative, exit is to decision block 49 which tests for the absence of an end-of-message code in the main storage area $M_i$. Absence of an end-of-message code detected in block 49 causes an exit to decision block 50 which tests for the presence of an error-free character in the temporary storage area. If there is one, exit is to operations bock 51 which directs the transfer of the error-free character to a corresponding position of the main storage area $M_i$. Exit from block 51 is to operations block 52 which increments the variable "j" by one. If a character in error is detected by block 50, exit is to operations block 52, so that the contents of the main storage area remain unchanged. Control now returns to operations block 46 to repeat blocks 46 to 52. As a result, if the previous message stored in a given main storage area $M_i$ has a greater number of errors than those in storage area SM, such error-containing characters in the main storage area $M_i$ are rewritten by error-free characters in the corresponding positions of temporary storage area SM. This is due to the fact that the likelihood of simultaneous occurrences of error in the corresponding character positions "j" of temporary and main storage areas is significantly small.

If the length of previous in main storage area $M_i$ is shorter than the length of characters stored in area SM, the end-of-message code of the previous message is detected in block 49 before the end-of message code of the next message is detected by block 47 and control exits from block 49 to operations block 53 to set flag "K" is one. Exit from decision block 48 in the following execution cycles is to operations block 51 until the presence of an end-of-message code is detected in the next message by block 47. The detection an end-of-message code in block 47 causes an exit to decision block 54 which tests to see if flag "K" has been set. Exit from block 54 is to operations block 55 to rewrite the storage position "j" of main storage area $M_i$ with the end of message code now stored in temporary storage area SM. Control then proceeds to operations block 56. Thus, the characters in temporary storage area SM having no corresponding characters in the main storage area $M_i$ are written into the corresponding positions of main storage area $M_i$ without error verification.

Exit from operations block 55 is to operations block 56 which directs the reading of all characters from the main storage area $M_i$ into the liquid crystal display 12. Exit from operations block 56 is to block 20 of the main routine (FIG. 3).

If the previous message is longer than the next message, the detection of the end-of-message code by block 47 takes place prior to the setup of flag "K" and exit from block 54 is to operations block 56. Thus, the characters in the main storage area $M_i$ having no corresponding characters in the temporary storage area SM remain unchanged.

Due to the rewriting process described above, the validity of a received message to be displayed is enhanced.

What is claimed is:

1. A radio display pager having a receiver for receiving a paging signal containing and address and a message and means for detecting when the address in the received paging signal coincides with a unique address assigned to the pager, wherein the message comprises a series of characters, said pager comprising:

means responsive to the detection of a coincidence between the received address and the unique address for detecting an error in each character of the received message, for identifying those characters having no error as being error-free characters, and for identifying those characters in error as being error-containing characters;

memory means having a first storage area for storing therein a received message and a plurality of second storage areas for respectively storing therein a plurality of different messages which are received in succession prior to the reception of the message in the first storage area, each of the messages stored in the first storage area and the second storage areas containing both the error-free and error-containing characters, the characters stored in the first storage area in order respectively corresponding in position to those stored in each of the second storage areas; and control means for (a) detecting a mismatch between each of the error-free characters in the first storage area and each of the positionally corresponding error-free characters in each of the second storage areas, for shifting all characters from each of the second storage areas to the next storage area of said plurality of second storage areas in order to vacate a storage area, and for shifting all characters from the first storage area to the vacated storage area and (b) detecting a match between each of the error-free characters in the first storage area and each of the positionally corresponding error-free characters in one of the second storage areas and replacing characters in said one of the second storage areas with all the positionally corresponding error-free characters in the first storage area.

2. A radio display pager as claimed in claim 1, wherein the control means provides a count indicating the number of the detected matches, effects the shifting of all characters if the count is smaller than a prescribed value, and effect the replacement of said characters if the count is greater than the prescribed value.

3. A method of correcting a message received by a radio display pager, the message having a plurality of characters, said method comprising the steps of:

receiving a message of first arrival and storing it in memory;

checking each character of the first arrival message to determine whether it contains an error;

receiving a message of second arrival and storing it in memory;

checking each character of the second arrival message to determine whether it contains an error and identifying those characters having no error as being error-free characters and identifying those characters in the error as being error-containing characters;

comparing between the error-free characters contained in corresponding positions of the first and second arrival messages to detect a coincidence therebetween;

counting the detected coincidence; and if the count of the detected coincidence exceeds a predetermined value, replacing at least one error-containing character of one of the message with an error-free character of the other message.

4. A radio display pager for receiving a paging signal containing an address and a message, said message comprising a series of characters, said pager comprising:

means for detecting when the address in the received paging signal coincides with a unique address assigned to the pager, means operable in response to the detection of a coincidence between the received address and the unique address for detecting an error in each character of the received message and identifying those characters having no error as being error-free characters and identifying those characters in error as being error-containing characters;

a memory having a temporary storage area and a plurality of main storage areas; and control means programmed to perform the steps of:

(a) writing a received message of first arrival into said temporary storage area and rewriting it into one of said main storage areas when a message of second arrival is received so that said temporary storage area stores a message of the most recent arrival and said main storage areas store a plurality of like messages of successively earlier arrivals at a given instant of time, each of the message in said temporary storage area and said main storage areas containing both error-free and error-containing characters, the characters stored in said temporary storage area respectively corresponding in position to the characters stored in each of the main storage areas, (b) maintaining a comparison between each of the error-free characters in one of the main storage areas to detect a mismatch or match therebetween, (c) if a mismatch is detected, transferring all characters of each of the main storage areas to an adjacent one of the main storage areas in order to vacate a storage area and transferring all characters of the temporary storage area to the vacated storage area for displaying the characters transferred thereto, (d) counting a match detected in step (b), (e) if the count of the match is smaller than a threshold value, transferring all characters of each of the main storage area and transferring all characters of the temporary storage area to the vacated storage area for displaying the characters transferred thereto, and (f) if the count of the match is greater than the threshold value, transferring all the error-free characters in said temporary storage area to one of said main storage areas for displaying the characters transferred thereto.

5. A radio display pager as claimed in claim 4, wherein the step (c) comprises:

(c1) repeating step (b) in response to the detection of a mismatch;

(c2) counting the mismatches; and (c3) if the count of the mismatches is equal to the number of said main storage areas, effecting the transfer of all characters of each of the main storage areas to said adjacent one of the main storage areas in order to vacate a storage area, and effecting the transfer of all characters of the temporary storage area to the vacated storage area for display.

6. A radio display pager as claimed in claim 4, wherein the step (e) comprises the step of repeating the steps (b) to (d) until the step (b) is repeated a number of times which is equal to the number of said main storage areas before effecting the transfer of said all characters of each of the main storage areas to said adjacent one of the main storage areas in order to vacate a storage area.

7. A method for reducing errors in a display of a radio display pager that receives a paging signal containing an address and a message, said message comprising a series of characters, said method comprising the steps of:

(a) detecting when the address in the receive paging signal coincides with a unique address assigned to the pager;

(b) detecting an error in each character of the received message for identifying those characters having no error as being error-free characters and identifying those characters in error as being error-containing characters;

(c) writing a received message of a first arrival into a temporary storage area and rewriting it into one of a plurality of main storage areas when a message of a second arrival is received so that said temporary storage area stores a message of the most recent arrival and said main storage areas store a plurality of like messages of successively earlier arrivals at a given instant of time, each of the messages in said temporary storage area and said main storage areas containing both error-free and error-containing characters, the characters stored in said temporary storage area respectively corresponding in position to those stored in each of the main storage areas;

(d) making a comparison between each of the error-free characters in the temporary storage area and each of the positionally corresponding error-free characters in one of the main storage areas to detect a mismatch or a match therebetween;

(e) if a mismatch is detected in the step (d), transferring all characters of each of the main storage areas to an adjacent one of the main storage areas in order to vacate a storage area and transferring all characters in the temporary storage area to the vacated storage area, and displaying the characters transferred to said vacated storage area;

(f) counting matches detected in the step (d);

(g) if the count of the matches is greater than said threshold value, transferring all the error-free characters in said temporary storage area to one of said main storage areas for displaying the characters transferred to said one of the main storage areas.

8. A method as claimed in claim 7, wherein the step (e) comprises the steps of:

(e1) repeating the step (d) in response to the detection of a mismatch;

(e2) counting the mismatches; and (e3) if the count of the mismatches is equal to the number of said main storage areas, effecting the transfer of said characters of each of the main storage areas to said adjacent one of the main storage areas to vacate a storage area and effecting the transfer of said all characters in the temporary storage area to the vacated storage area for display.

9. A method as claimed in claim 7, wherein the step (g) comprises the added step of repeating the steps (d) to (f) until the step (d) is repeated a number of times which is equal to the number of said main storage areas before effecting the transfer of said all of the characters of each of the main storage areas to said adjacent one of the main storage areas in order to vacate a storage area and effecting the transfer of said all characters of the temporary storage area to the vacated storage area for display.

* * * * *